US006213812B1

(12) United States Patent
Kan

(10) Patent No.: US 6,213,812 B1
(45) Date of Patent: Apr. 10, 2001

(54) GROUNDING STRUCTURE OF THE EAR PHONE SOCKET

(75) Inventor: Shin Nan Kan, Hsinchu Hsien (TW)

(73) Assignee: Singatron Enterprise Co., Ltd., Hsinchu Hsien (TW)

( * ) Notice: Subject to any disclaimer, the term of this patent is extended or adjusted under 35 U.S.C. 154(b) by 0 days.

(21) Appl. No.: 09/283,218

(22) Filed: Apr. 1, 1999

(51) Int. Cl.[7] ..... H01R 13/648
(52) U.S. Cl. ..... 439/607; 439/939; 381/384
(58) Field of Search ..... 381/324, 361, 381/366, 384; 439/361, 607, 174, 939

(56) References Cited

U.S. PATENT DOCUMENTS 4,634,816 * 1/1987 O'Malley et al. ..... 381/384
4,913,664 * 4/1990 Dixon et al. ..... 439/607
5,448,646 * 9/1995 Lucey et al. ..... 381/384
5,898,789 * 4/1999 Nichols et al. ..... 381/361
6,007,379 * 12/1999 Michaelis et al. ..... 439/607
6,066,001 * 5/2000 Liptak et al. ..... 439/607
6,113,427 * 9/2000 Wu ..... 439/607

* cited by examiner

*Primary Examiner*—Curtis Kuntz
*Assistant Examiner*—Suhan Ni
(74) *Attorney, Agent, or Firm*—Rosenberg, Klein & Lee

(57) ABSTRACT

The present invention is related to a grounding structure of the ear phone socket, which is mainly mounted with an easily clip-assembled housing in the exterior of the ear phone socket and is assembled with fully overcoat-typed cover in its exterior. Further, flexible wing plates are set to the central portion of outside housing such that it forms the effective contact with the housing to obtain the grounding effect while the ear phone socket is assembled with the audio. Thus it can upgrade the quality of sound effect of the ear phone.

5 Claims, 7 Drawing Sheets

GROUNDING STRUCTURE OF THE EAR PHONE SOCKET

BACKGROUND OF THE INVENTION

In many electrical utilities, in order to prevent the effects of the electrostatics or the other abnormal electrical ions, it is necessary to add grounding wires for the purpose of discharging. For ordinary audio apparatus, apparently, this kind of grounding structure is more important. However, in most of the audio apparatus, designs related to their ear phone sockets (1) are shown in FIG. 1, which only have the conventional basic functions, and do not have the related arrangements of grounding structures, thus lead to the shortcomings for usage.

OBJECT OF THE INVENTION

Owing to this, the present invention mainly is to provide an innovative grounding structure of the ear phone socket for fixing the disadvantages of the conventional products. Now, by fitting with the drawings, the features and effectiveness of the present invention are described as the following:

DETAILED DESCRIPTION OF THE INVENTION

Figure 1:
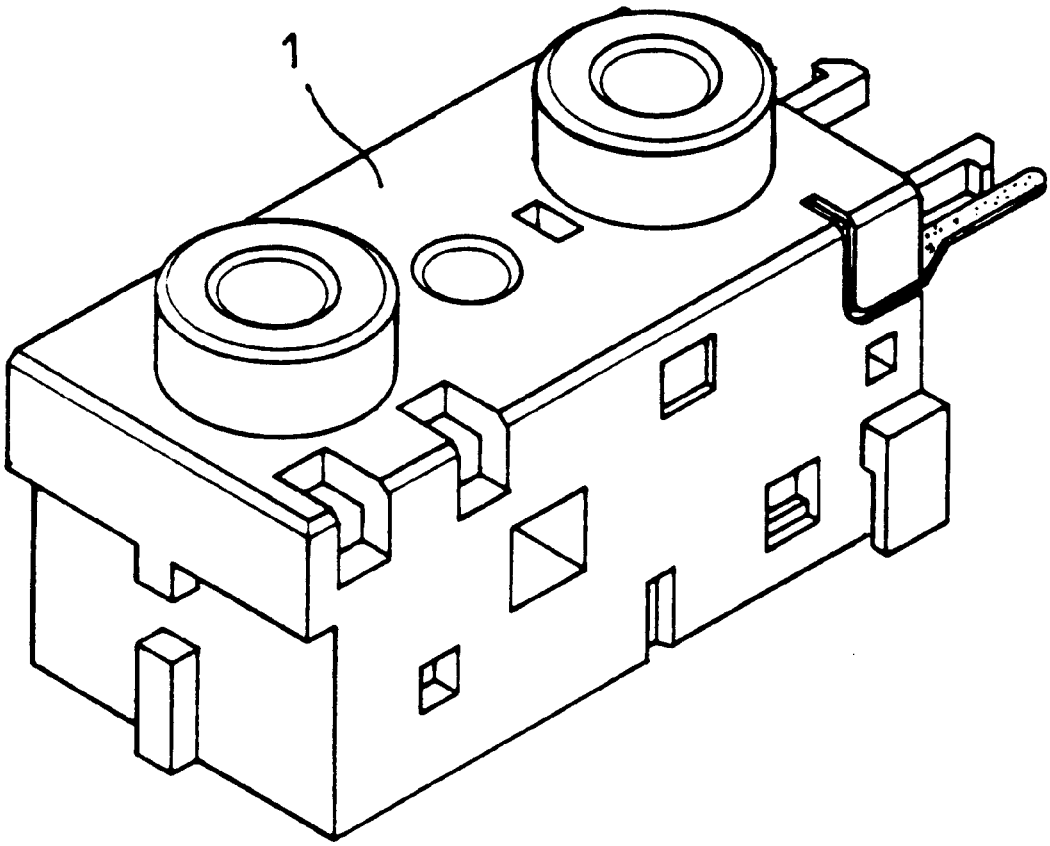
FIG. 1 (prior art)
FIG. 1 is a three dimensional diagram of the conventional ear phone socket.
Figure 2:
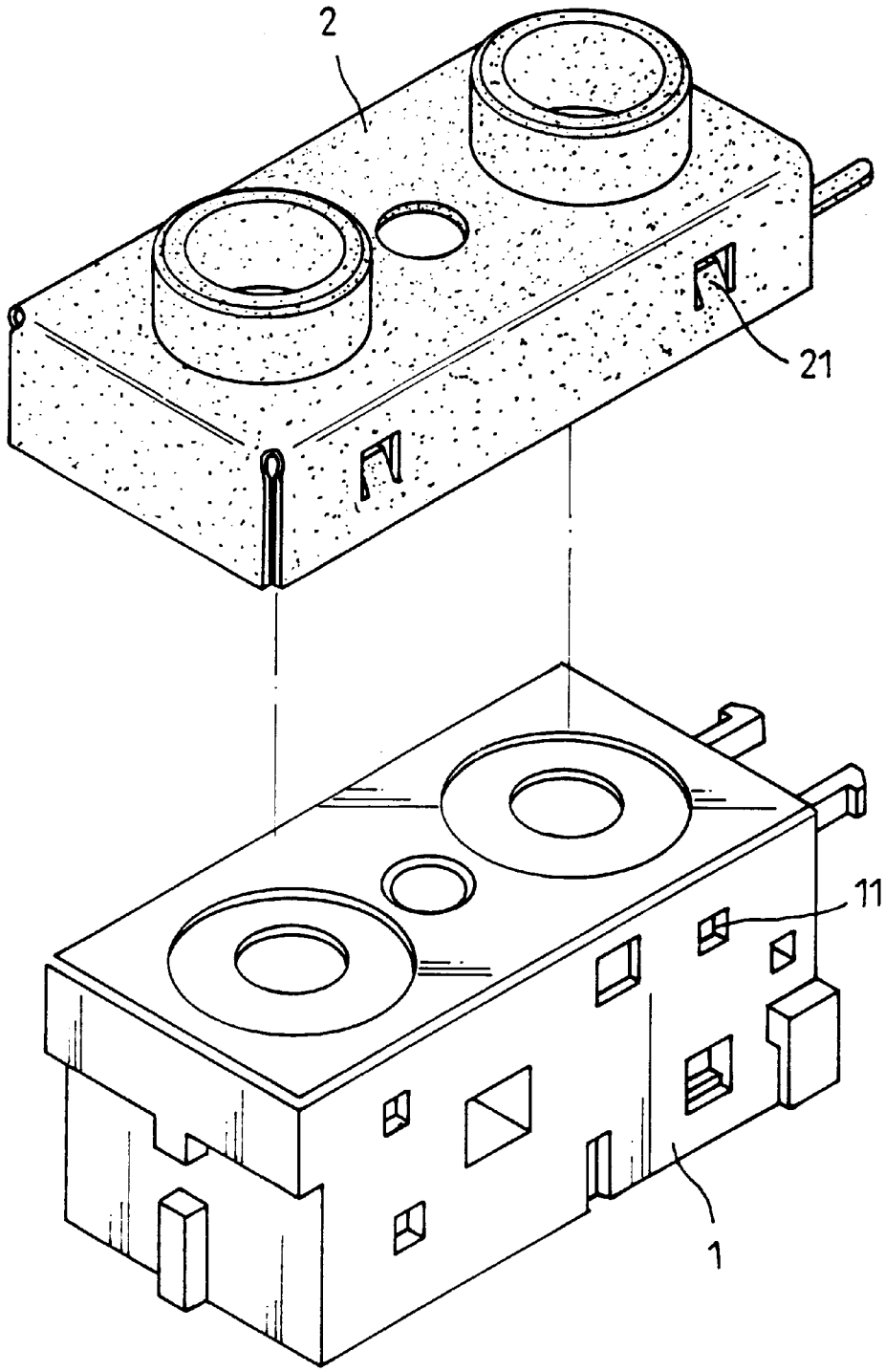
FIG. 2 is a three dimensional exploded diagram of the present invention.
Figure 3:
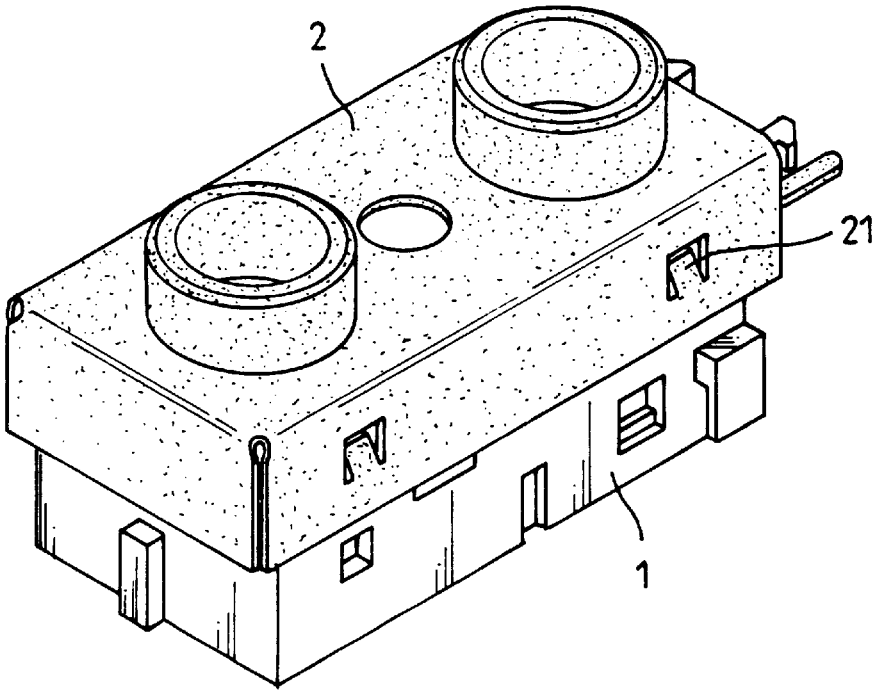
FIG. 3 is a three dimensional assembling diagram of FIG. 2.
Figure 4:
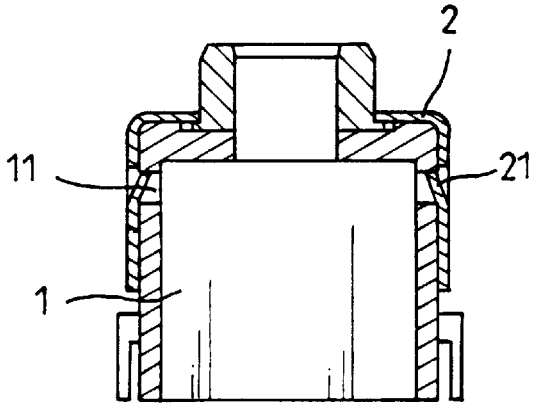
FIG. 4 is an assembling section diagram of FIG. 2.

Please refer to those shown in FIG. 2 to FIG. 4, the present invention mainly is set with engaging holes (11) at both ends of the ear phone socket (1). Further, a overcoat typed housing (2) is able to be cover-assembled to a surface of the ear phone socket (1) with inward slanted clip-assembling edges (21) set at both side edges of outside housing (2). Therefore, after the outside housing (2) is sleeved on the upper portion of the ear phone socket (1), each clip-assembling edges (21) immediately are clipped into the engaging holes (11) to form a effective binding status.

After assembling a phone socket (1) with an outside housing (2), they are set to the audio apparatus, and the housing (2) also is the apparatus assembled in the audio and with quite large contact area. Therefore it can obtain the excellent grounding capability and achieve the predicting object of the present invention.

Figure 5:
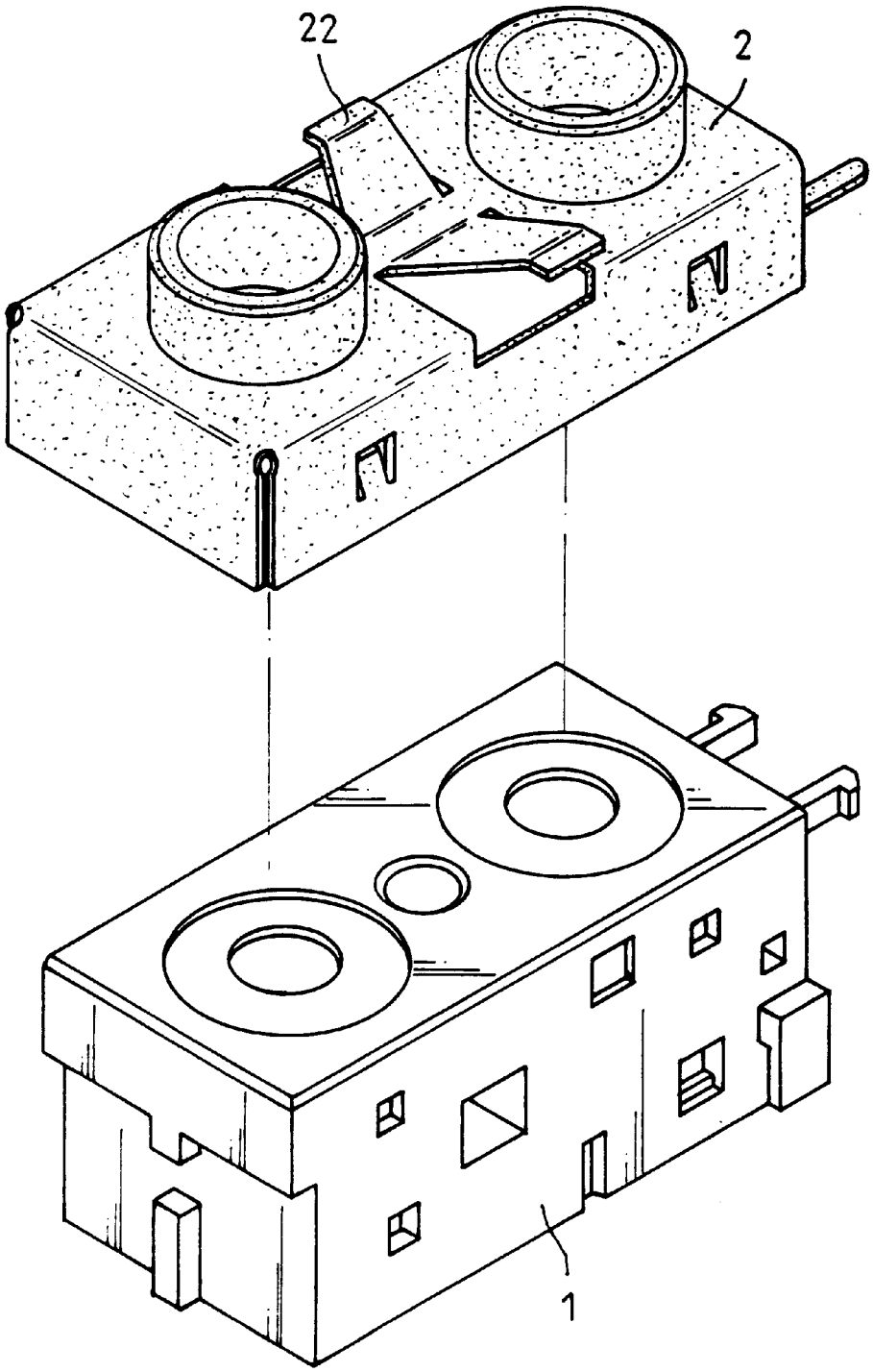
FIG. 5 is a three dimensional exploded diagram of another example of the present invention.
Figure 6:
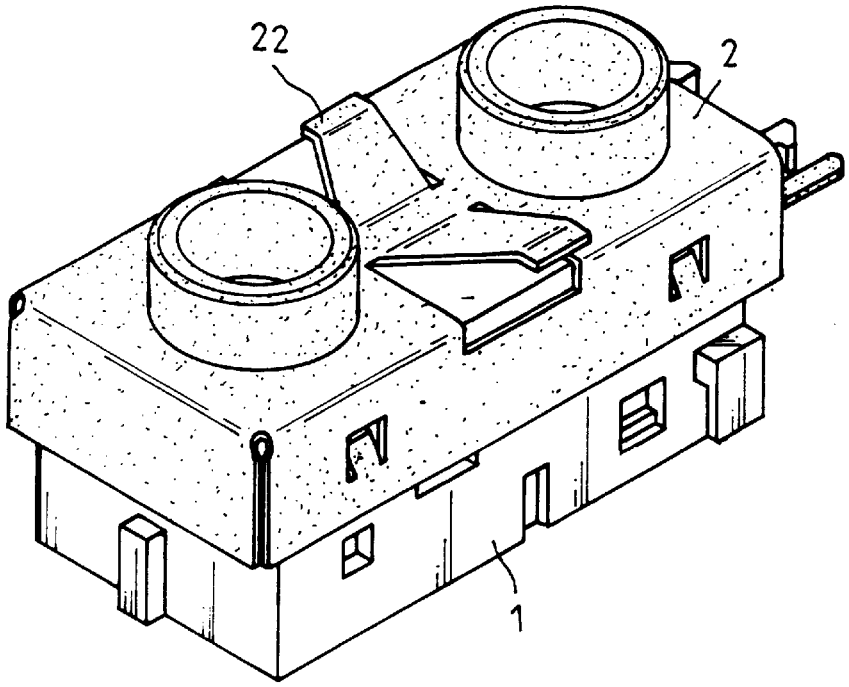
FIG. 6 is an assembling diagram of FIG. 5.
Figure 7:
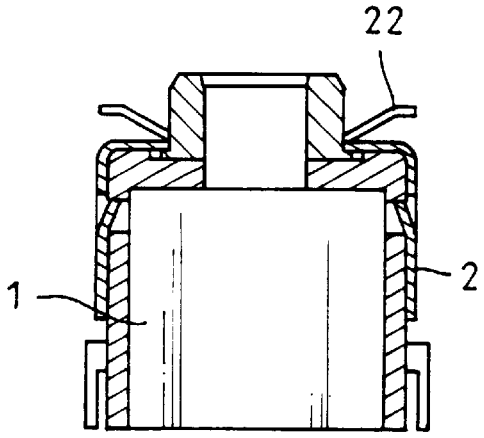
FIG. 7 is a section diagram of FIG. 6.

As shown in FIG. 5 to FIG. 7, the present invention is able to set a group of flexible wings (22) which extent in a slanted direction to a central portion of the outside housing (2). By utilizing the flexible contact body, it will be able to upgrade the grounding effect and thus improve the sound quality of audio apparatus.

Figure 8:
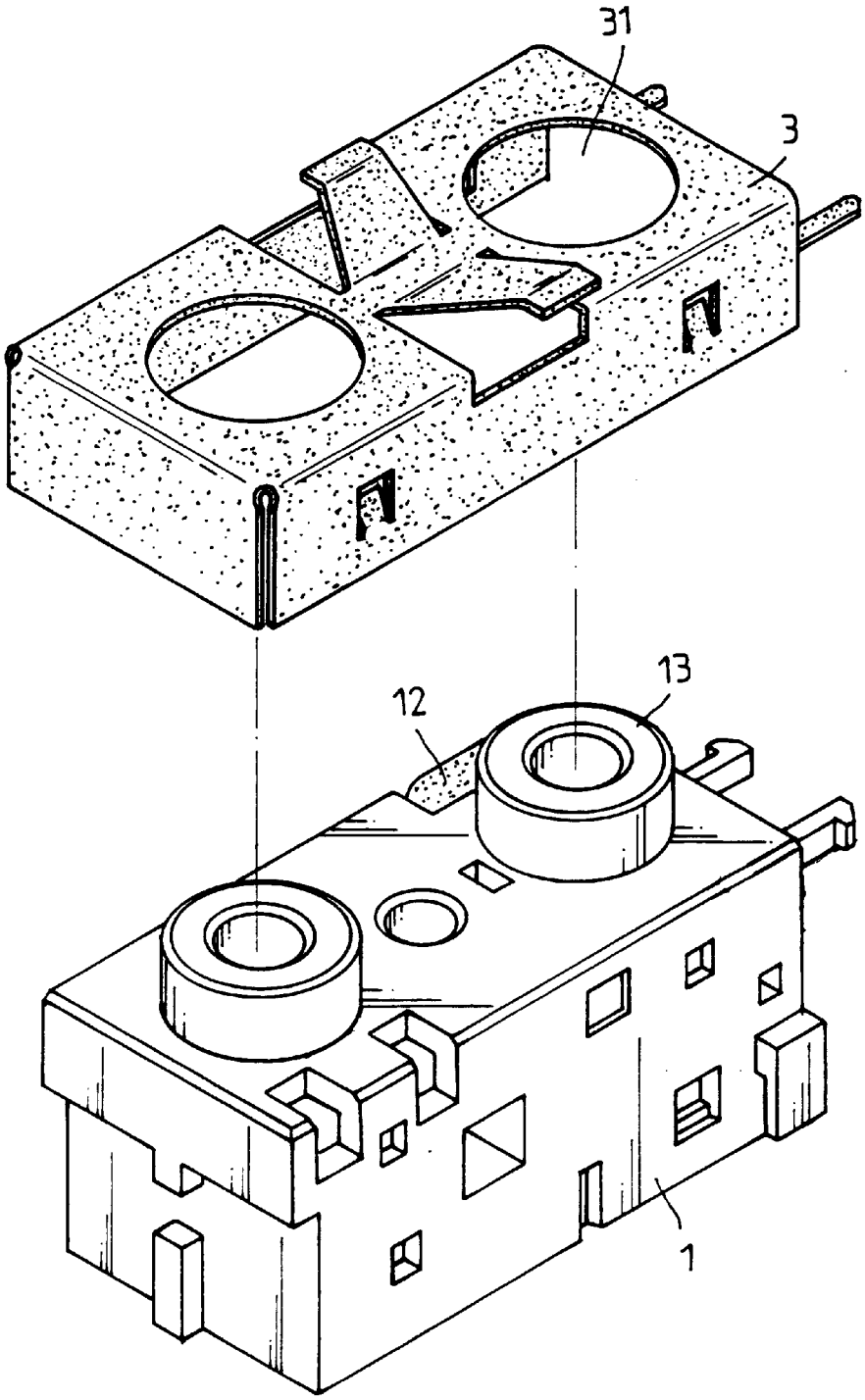
FIG. 8 is a three dimensional exploded diagram of a further example of the present invention.
Figure 9:
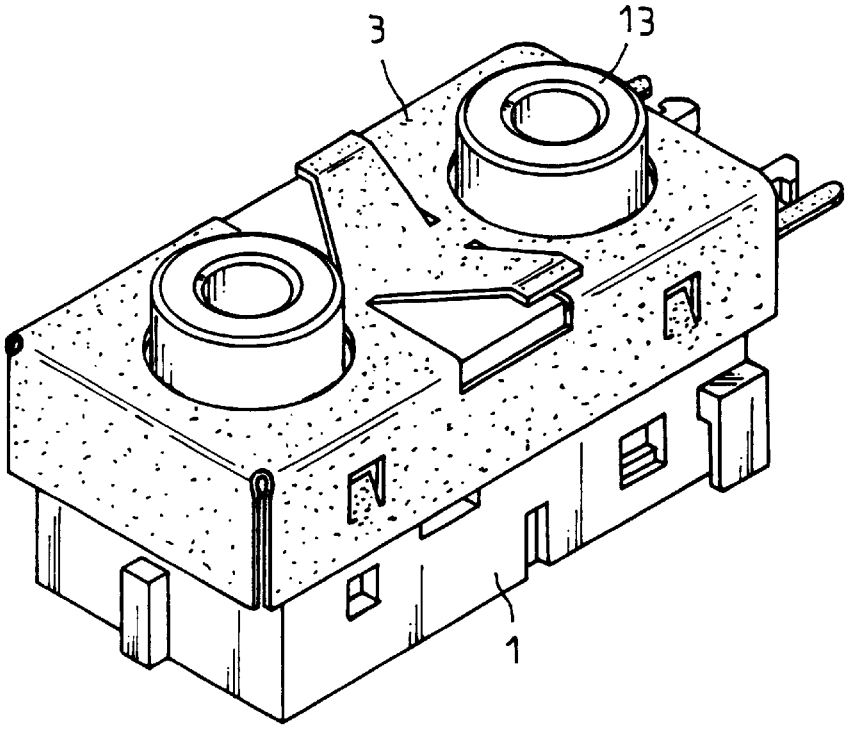
FIG. 9 is an assembling diagram of FIG. 8.
Figure 10:
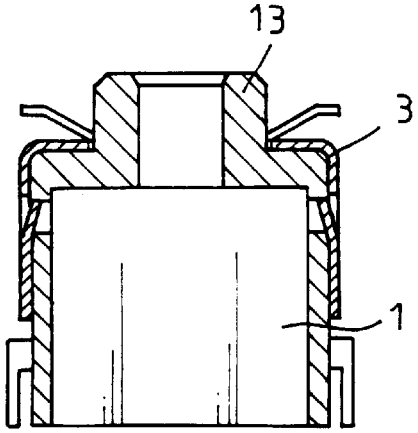
FIG. 10 is a section diagram of FIG. 9.

Please refer to those shown in FIG. 8 to FIG. 10, the present invention also can be set as open hole typed outside housing (3) for the sleeve-assembling the conventional ear phone sockets (1) such that the socket poles (13) are exposed out through the open holes (31). Further, a metal plate (12) is set to the other side of the ear phone socket to enhance the grounding capability.

Generally speaking, the main characteristic of the present invention is to design a grounding device with the delicate structure which can be easily to be utilized in the ear phone socket. It only needs easy assembly to finish the clip-assembling, and achieve the grounding effect and reduce the electromagnetic radiation. It is obviously provided with the practical value of first inventiveness, thus it fits with the conditions for patent and we file the application according to the law.

What is claimed is:

1. A grounded ear phone socket assembly comprising:

(a) an ear phone socket device having an upper portion and a side portion extending transversely therefrom, said side portion having formed therein a plurality of engaging holes, said upper portion defining at least one socket opening for receiving an ear phone plug; and, (b) a grounding housing coupled to said ear phone socket device, said grounding housing including a central portion and an edge portion extending transversely therefrom, said central portion extending over said upper portion of said ear phone socket device, said edge portion having formed thereon a plurality of inwardly directed slanted clip-assembling portions each engaging in releasably locked manner one said engaging hole of said ear phone socket device, whereby said central portion is securely retained over said ear phone socket device upper portion.

2. The grounded ear phone socket assembly as recited in claim 1 wherein said central portion of said grounding housing has formed thereon a plurality of flexible wing members projecting outward in sloped manner therefrom.

3. The grounded ear phone socket assembly as recited in claim 1 wherein said central portion of said grounding housing has formed therein at least one access opening aligned with said socket opening of said upper portion of said ear phone socket device in open communication therewith.

4. The grounded ear phone socket assembly as recited in claim 3 further comprising a metal plate disposed between said ear phone socket device and said grounding housing.

5. The grounded ear phone socket assembly as recited in claim 4 wherein said metal plate is disposed between said side portion of said ear phone socket device and said edge portion of said grounding housing.

* * * * *